US007841310B2

(12) United States Patent
Child

(10) Patent No.: US 7,841,310 B2
(45) Date of Patent: Nov. 30, 2010

(54) SPOOL VALVE FOR VCT LOCKING PIN RELEASE MECHANISM

(75) Inventor: Matt James Child, Warwick (GB)

(73) Assignees: Ford Global Technologies, LLC, Dearborn, MI (US); Jaguar Cars Limited (GB)

( * ) Notice: Subject to any disclaimer, the term of this patent is extended or adjusted under 35 U.S.C. 154(b) by 492 days.

(21) Appl. No.: 11/877,847

(22) Filed: Oct. 24, 2007

(65) Prior Publication Data

US 2008/0135118 A1 Jun. 12, 2008

(30) Foreign Application Priority Data

Dec. 7, 2006 (GB) ..... 0624438.8

(51) Int. Cl.
*F01L 1/34* (2006.01)

(52) U.S. Cl. ..... 123/90.15; 123/90.12; 123/90.13; 123/90.17; 137/625

(58) Field of Classification Search ..... 123/90.15, 123/90.16, 90.17, 90.18, 90.12, 90.13; 137/511, 137/625
See application file for complete search history.

(56) References Cited

U.S. PATENT DOCUMENTS 5,002,023 A 3/1991 Butterfield
5,107,804 A 4/1992 Becker
5,669,343 A * 9/1997 Adachi ..... 123/90.17
7,124,722 B2 * 10/2006 Smith ..... 123/90.17
2004/0055550 A1 3/2004 Smith

FOREIGN PATENT DOCUMENTS

EP 1400661 A1 3/2004
WO 2006011648 A1 2/2006

OTHER PUBLICATIONS

European Extended Search Report dated Jul. 27, 2010, pp. 1-4.

* cited by examiner

*Primary Examiner*—Ching Chang
(74) *Attorney, Agent, or Firm*—Julia Voutyras; Brooks Kushman P.C.

(57) ABSTRACT

A spool valve 10 for a variable camshaft timing (VCT) phaser for an internal combustion engine comprises a spool 11 slidable in a bore 12 in a valve sleeve 13, the spool 11 having spaced apart lands 14-17 dividing the bore 12 into chambers 41, 42, 43 between adjacent lands. The valve sleeve 13 has fluid passages 22-27 including a lock passage 26 communicating with a lock pin 31, a vent passage 27 communicating with a fluid sump 35, and a lock pin oil feed passage 22, with the spool 11 being slidable in the bore 12 to interconnect select passages via particular chambers, wherein the vent passage 27 and the lock pin passage 26 are connectable with different chambers 43 and 42 respectively. The arrangement avoids unnecessary operation of the lock pin 31.

11 Claims, 3 Drawing Sheets

SPOOL VALVE FOR VCT LOCKING PIN RELEASE MECHANISM

FIELD OF THE INVENTION

The invention is related to a hydraulic control system for controlling the operation of a variable camshaft timing (VCT) system. More specifically, the present invention relates to a control system utilized to lock and unlock a lock pin in a VCT phaser.

BACKGROUND OF THE INVENTION

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

U.S. Pat. No. 5,002,023 describes a VCT phaser having a pair of oppositely acting hydraulic cylinders which operate with a hydraulic system which includes appropriate hydraulic flow elements to selectively transfer hydraulic fluid from one of the cylinders to the other to advance or retard the circumferential position of a camshaft relative to a crankshaft. The VCT system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure on one end of the spool and the relationship between the hydraulic force on the one end and an opposing direct mechanical force from a compression spring.

However, when the engine is shut down, oil can leak from the VCT phaser. Consequently, during an engine start, before the engine oil pump generates sufficient oil pressure, the lack of controlling oil pressure in the chambers can allow the phaser to oscillate excessively, producing noise and possibly damaging the mechanism. Hence, it is desirable to have the phaser locked in a particular position while the engine is being started. One known solution is to employ a lock pin that can lock the phaser in a specific phase angle position relative to the crankshaft when insufficient oil exists in the chambers. These lock pins are typically spring loaded to engage and are released using engine oil pressure.

US Patent Application 2004/0055550A1 discloses a VCT system in which the spool valve used to control the VCT mechanism is also used to actively control the locking pin. In other words, a VCT system that utilizes a spool valve for controlling the VCT mechanism is actively used to control a locking pin. The spool valve utilises a spool having multiple lands such that the position of the spool directly influences whether source oil is supplied to both the locking pin and to either the advance or retard chambers of the phaser. The VCT mechanism provides for adjusting and maintaining an angular relationship between a camshaft and a crankshaft or another shaft using a pressurized fluid, and has a phaser using the pressurized fluid for adjusting and maintaining the angular relationship, the pressurized fluid flows from a fluid source to a fluid sink. The VCT mechanism has: a locking pin disposed to engage a recess with the pressurized fluid acting on the lock pin to thereby disengage the lock pin from the recess; a spool valve having three lands which co-operate with fluid passageways to control the flow of the pressurized fluid for adjusting and maintaining the angular relationship, and which also control the timing of the pressurized fluid flowing from the fluid source toward the lock pin and from the lock pin toward the fluid sink.

The spool position is monitored and controlled by solenoid closed loop control. Under normal operating conditions a hydraulically actuated or supported VCT with an active lock pin will not unlock until sufficient oil pressure is available and there is a signal from the ECU (engine control unit). Provided both are present, the spool will open the oil passageway to the lock pin allowing pressurized oil to unlock the pin. A disadvantage of this arrangement is that every time the spool returns to a base position (to return the VCT to base position), the lock pin oil pressure is shut-off and the pin engages. During the life of the engine, the lock pin will engage and disengage numerous times inducing a high wear rate on the lock pin, its bore and the pin seat. It also induces a delayed pin unlock which in turn delays the phaser response time.

SUMMARY OF THE INVENTION

According to an aspect of the present invention there is provided a spool valve for a variable camshaft timing (VCT) phaser for an internal combustion engine. The spool valve has a spool slidably located within a bore in a valve sleeve, the spool having a plurality of spaced apart lands dividing the bore into chambers between adjacent lands. The valve sleeve has a plurality fluid passages therein which open into the bore and which include a lock passage communicating with a lock pin, a vent passage communicating with a fluid sump, and a lock pin oil feed passage. The spool can slide within the bore to interconnect select passages via particular chambers. The vent passage and the lock pin passage are connectable with different chambers.

In one embodiment, the spool has four lands dividing the bore into three chambers. A first chamber is defined between the inner first land and a second land located axially outwardly thereof. The plurality of passages include an advance passage, a common oil feed passage, and a retard passage in fluid communication with the retard chamber. The passages are selectively connectable through the first chamber.

When the spool is in a null position, the advance passage and the retard passage are blocked by the first land and the second land, and the lock pin passage is in fluid communication with the second chamber, such that the lock pin is in an unlocked position with the third land blocking communication between the lock pin oil feed passage and the lock pin passage.

Conveniently, a second chamber is defined between a third land located axially outwardly of the second land and a third chamber is defined between the third land and the outer fourth land. The spool can be displaced in the bore to either interconnect the lock pin oil feed passage and lock pin passage through the second chamber or interconnect the lock pin oil feed passage and vent passage through the third passage.

The spool may be biased to a base position by a spring such that in the base position the third land interrupts communication between the lock pin oil feed and the vent passage.

The invention also has a variable cam timing system for an internal combustion engine and having a spool valve according to the first aspect of the invention and to a motor vehicle having an internal combustion engine with such a VCT system.

Another aspect of the invention provides a method of controlling a variable timing system for an internal combustion engine having at least one camshaft, the system including a spool valve according to the first aspect of the invention, such that the lock pin passage is never directly connectable with the vent passage.

In one embodiment, communication between the vent passage and the lock pin oil feed passage is always closed when the spool is in the base position.

BRIEF DESCRIPTION OF THE DRAWINGS

The invention will be described by way of example and with reference to the accompanying drawings, in which.

DETAILED DESCRIPTION

Figure 1:
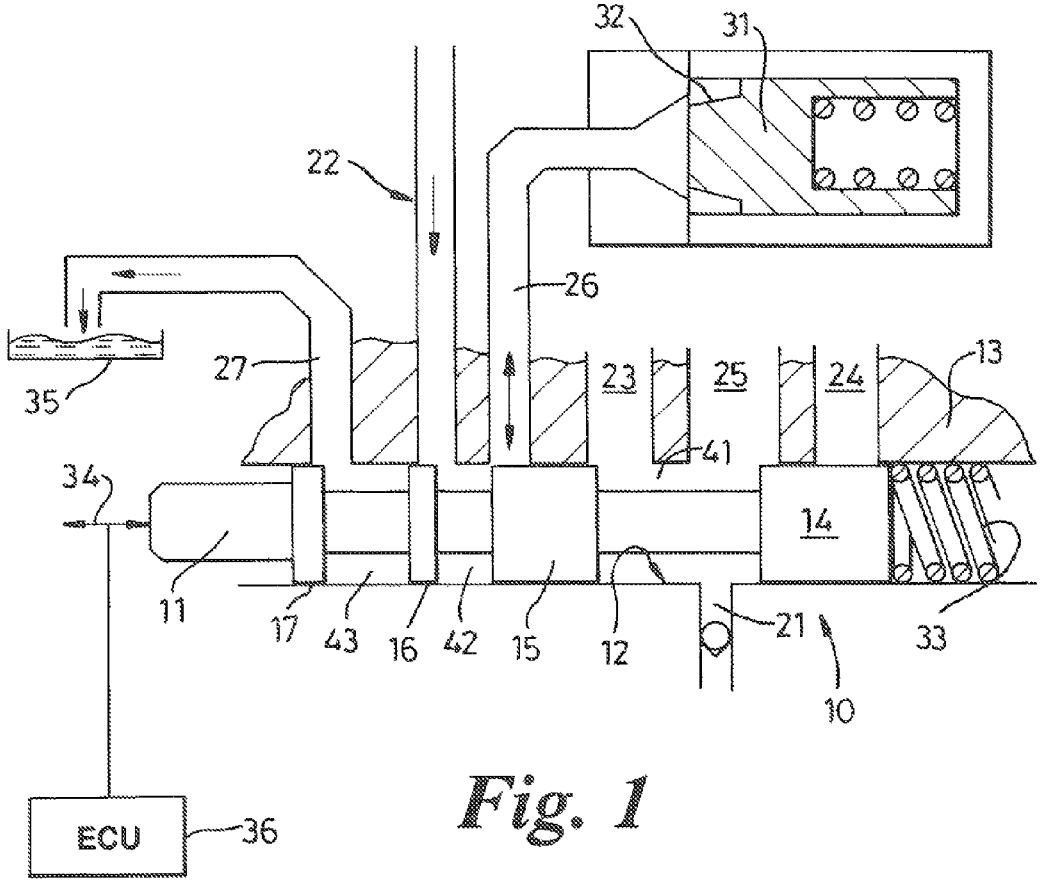
FIG. 1 is a schematic diagram of a lock pin control valve according to the present invention.

The lock pin control valve shown in FIGS. 1-6 is particularly useful for a VCT system of the type described in US 2004/0055550 which is hereby incorporated herein by reference. However, the workings of the system will be sufficiently explained for an understanding of the present invention. With particular reference to FIG. 1, there is shown a part of a VCT system including a control valve 10 in accordance with an aspect of the present invention. Control valve 10 has a cylindrical spool 11 slidable in the bore 12 of a valve sleeve 13. The spool 11 has four lands 14, 15, 16, and 17 which co-operate with the bore 12 to divide the bore into three separate chambers 41, 42, and 43. The engine oil supply is pumped to the first chamber 41 in the bore 12 through a first passage 21 which incorporates a check valve. Engine oil is also pumped directly to the second and third chambers 42, 43 through a second passage 22 which is spaced along the bore from the first passage 21. The second passage 22 may branch off engine oil supply passage 21.

A passage 23 leads to the advance chamber (not shown) of a VCT phaser and similarly another passage 24 leads to the retard chamber (not shown) of the phaser, the two chambers being separated by a vane which forms part of the phaser. The VCT phaser shown in US 2004/0055550 is of the kind known as a "cam torque actuated" (CTA) phaser, an oil supply passage with check valves (not shown) providing a recycling line to allow oil to pass between the advance and retard chambers. The direction of the oil flow depends on the position of spool 11 in sleeve 13, in the manner described in U.S. Pat. No. 5,107,804, entitled Variable Camshaft Timing for Internal Combustion Engine which is also hereby incorporated herein by reference. A control solenoid, represented by a double headed arrow 34, acts on one end of spool 11 and controls movement of the spool relative to valve sleeve 13 under the control of an engine control unit (ECU) 36. The force of solenoid 34 opposes the force of a compression spring 33 acting against the other end of spool 11 so that the spool position is determined by the solenoid current. When solenoid 34 is inactive, spool 11 is biased by spring 33 to a base position.

A lock passage 26 directs oil from bore 12 to and from a lock pin 31 which is spring loaded to fit into a recess 32 to thereby lock the phaser in one position. A vent passage 27 vents to the engine oil sump 35 allowing oil to flow from valve 10 back to the oil sump.

Figure 2:
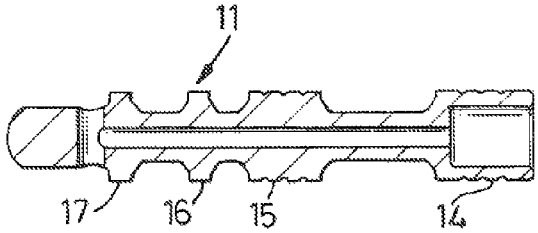
FIG. 2 is a cross section through a valve spool for use in the lock pin control valve shown in FIG. 1.
Figure 3:
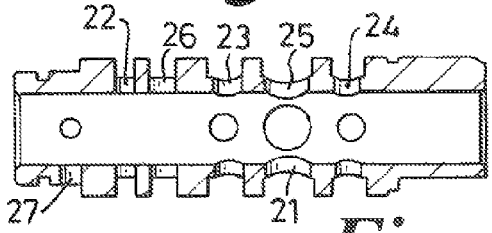
FIG. 3 is a cross section through a valve sleeve for use in the lock pin control valve shown in FIG. 1.
Figure 4:
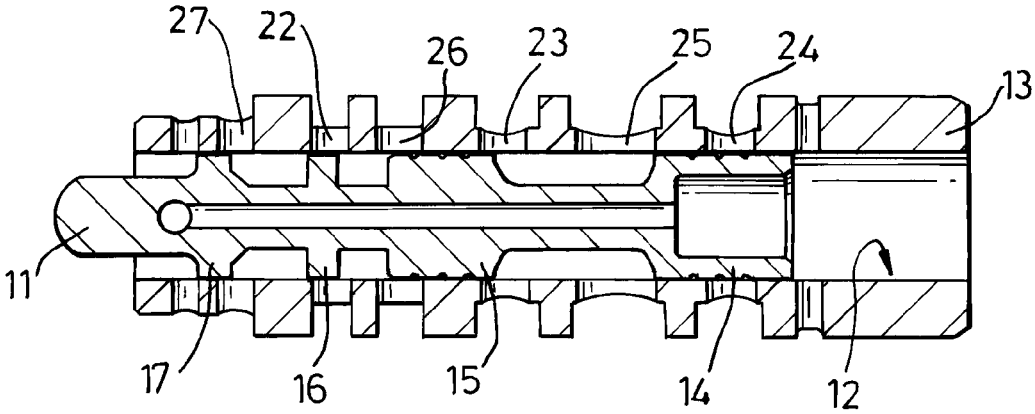
FIG. 4 is a cross section of a lock pin control valve incorporating the valve spool shown in FIG. 2 with the valve sleeve shown in FIG. 3 and showing the spool in a base position.

With further reference to FIGS. 2, 3 and 4, spool 11 is in the base position, that is, biased to an inactive position by spring 33, when no current is supplied to the solenoid. The first chamber 41 acts to interconnect the passages utilized in the operation of the advance and retard vane and the second and third chambers 42, 43 are utilized in the lock pin control. In this condition shown in FIG. 4, land 14 blocks passage 24 and passages 23 and 25 are open. Land 16 is positioned leftwards of oil feed passage 22 which is open to lock passageway 26. Land 16 also closes lock pin oil feed passage 22 from vent passage 27. Second land 15 separates the lock pin control side of the spool valve from the VCT control. In this condition with the engine switched off, the lock pin is engaged.

Figure 5:
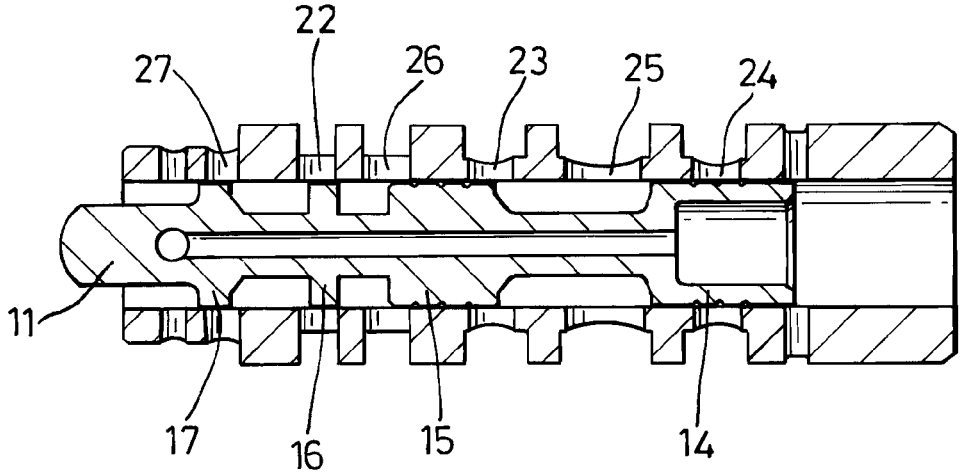
FIG. 5 is a cross section based on FIG. 4 with the spool in the position assumed during engine starting.

To maintain control during engine starting when oil pressure is insufficient to control the VCT, lock pin 31 is maintained in its locked position by moving the spool position using a predetermined current supplied by ECU 36 to the control solenoid 34. ECU 36 monitors various engine parameters, receiving signals from sensors corresponding to camshaft and crankshaft positions and utilizes this information to operate the control solenoid through a closed-loop feedback system which corrects for any phase angle error. In FIG. 5, spool 11 has moved inwards (rightwards as shown) sufficient for land 16 to close bore 12 between lock pin oil inlet passage 22 and lock passage 26 while simultaneously opening lock pin oil inlet passage 22 to vent passage 27.

When oil pressure in the engine begins to build and there is sufficient oil pressure available for operation of the VCT control to unlock the pin (normally within 2 seconds of the engine start), ECU 36 sets the control solenoid current to zero and spring 33 pushes spool 11 further outward. Land 16 co-operating with bore 12 shuts off vent passage 27 and moves to open lock passage 26 permitting oil flow from lock pin oil inlet passage 22 to unlock lock pin 31, such position of spool 11 shown in FIG. 4.

Figure 6:
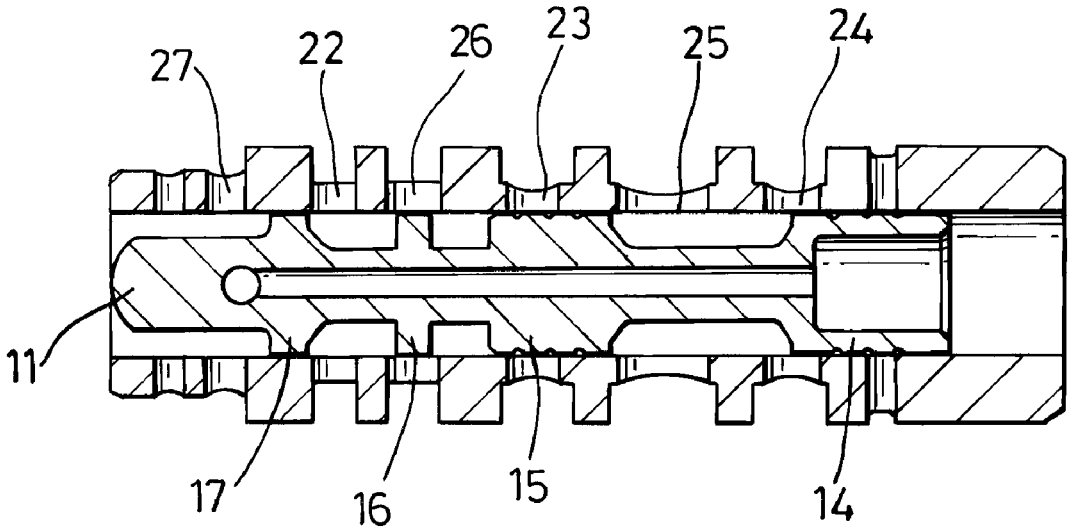
FIG. 6 is a cross section based on FIG. 4 of the lock pin control valve of FIG. 2 with the spool in the position assumed during when the VCT system is active and the VCT phaser is advanced.

During the operation of the phaser (advancing and retarding) the spool will shuttle in and out from the retarded position shown in FIG. 5 to the advanced position shown in FIG. 6 as is normal, passing through the null position when both advance and retard passageways 23, 24 are blocked. Land 16 passes back and forth and may momentarily cut off lock pin oil supply passage 22 from lock passage 26. However, since vent passage 27 remains closed, pressure in lock pin passage 26 will not be lost over such short time periods. However, if the engine is switched off, spool 11 will return to the base position shown in FIG. 4 under the bias of spring 33 and, since vent passage 27 is closed, lock pin 31 remains disengaged until such time as the oil pressure falls due to system leakage. This reduces the number of pin engagement and disengagement operations to help reduce wear.

The provision of the additional land 16 on spool 11 controls the flow of oil back to the vent or sump such that lock passage 26 is never directly connected to vent passage 27.

While several modes for carrying out the invention have been described in detail, those familiar with the art to which this invention relates will recognize alternative designs and embodiments for practicing the invention. The above-describe embodiments are intended to be illustrative of the invention, which may be modified within the scope of the following claims.

I claim:

1. A hydraulic control system for a variable camshaft timing (VCT) phaser for an internal combustion engine, comprising:

a spool valve having a spool slidably located within a bore in a valve sleeve, said spool comprising: first, second, third, and fourth lands spaced apart dividing said bore into first, second, and third chambers between adjacent lands, said valve sleeve having a plurality of fluid passages which open into said bore, said passages comprising:

a lock pin oil feed passage;

a lock pin passage communicating with a lock pin; and a vent passage communicating with a fluid sump;

wherein spool valve is incapable of attaining a position where said lock pin passage is in communication with said vent passage.

2. The hydraulic control system of claim 1 wherein said second land is arranged between said first and third lands and said third land is arranged between said second and fourth lands.

3. The hydraulic control system of claim 1 wherein said first chamber is defined between said first land and said second land and said plurality of passages further comprises: an advance passage in communication with an advance chamber of the VCT, a common oil feed passage, and a retard passage in communication with a retard chamber of the VCT, said advance and retard passages selectively connectable through the first chamber.

4. The hydraulic control system of claim 3, wherein when said spool is in a null position, said advance passage is blocked by said first land, said retard passage is blocked by said second land, and said lock pin passage is in fluid communication with a second chamber defined between said second land and said third land, such that the lock pin is in an unlocked position with said third land blocking communication between said lock pin oil feed passage and said lock pin passage.

5. The hydraulic control system of claim 3 wherein said second chamber is defined between said second land and said third land, said third chamber is defined between said third land and said fourth land, and said spool is capable of being displaced in a first position in which said lock pin oil feed passage is in communication with said lock pin passage and a second position in which said lock pin oil feed passage is in communication with said vent passage.

6. The hydraulic control system of claim 5, further comprising:

a solenoid coupled to said spool; and a spring coupled to said spool, wherein said spool is biased to a base position by said spring when no current is supplied to said solenoid, such base position comprising said third land interrupting fluid communication between said lock pin oil feed passage and said vent passage.

7. The hydraulic control system of claim 1, further comprising:

a solenoid coupled to said spool; and a spring coupled to said spool;

wherein all operational positions attainable under action of said solenoid and said spring causes said third land prevents communication between said vent passage and said lock pin passage.

8. The system of claim 1, further comprising:

a spring coupled to said spool on a first end;

a solenoid coupled to said spool on a second end;

an electronic control unit coupled to said solenoid, said electronic control unit commanding a current to be supplied to said solenoid and said current supply determines a position that said spool attains.

9. The system of claim 8 wherein when no current is supplied to said spool, the spool attains a base position in which fluid communication between said lock pin oil feed passage and said vent passage is blocked.

10. The system of claim 8 wherein said second land is arranged between said first and third lands and said third land is arranged between said second and fourth lands and said spring is coupled to an end of said spool farthest said first land.

11. The system of claim 8 wherein said fluid passages further comprise an advance passage and a retard passage, said spool having an advance position in which said retard passage is occluded by the first land and a retard position in which said advance passage is occluded by the second land.

* * * * *